US005765621A

United States Patent [19]

Bryant

[11] Patent Number: 5,765,621

[45] **Date of Patent: *Jun. 16, 1998**

[54] WINDOW BLIND WITH STORAGE RAIL

[76] Inventor: David C. Bryant, 5562 N. Elston Ave., Chicago, Ill. 60630

[ * ] Notice: The term of this patent shall not extend beyond the expiration date of Pat. No. 5,655,590.

[21] Appl. No.: 649,461

[22] Filed: May 17, 1996

Related U.S. Application Data

[63] Continuation-in-part of Ser. No. 444,270, May 18, 1995.

[51] Int. Cl.[6] ..... E06B 9/30

[52] U.S. Cl. ..... 160/168.1 R; 160/178.1 R

[58] Field of Search ..... 160/173 R, 168.1 R, 160/176.1 R, 178.1 R, 178.3 R, 177 R; 27/24.5

[56] References Cited

U.S. PATENT DOCUMENTS

| | | |
|---|---|---|
| 1,878,186 | 9/1932 | Rudolph . |
| 2,416,530 | 2/1947 | Lidin . |
| 2,592,995 | 4/1952 | Anderle . |
| 2,598,575 | 5/1952 | Martin et al. . |
| 2,616,496 | 11/1952 | Junkunc . |
| 2,618,329 | 11/1952 | Nelson . |
| 2,627,917 | 2/1953 | Lino . |
| 2,697,487 | 12/1954 | Nelson . |
| 2,756,816 | 7/1956 | Radel et al. . |
| 2,771,135 | 11/1956 | Walker . |
| 2,838,110 | 6/1958 | Lando . |
| 2,861,631 | 11/1958 | Anderle . |
| 2,884,052 | 4/1959 | Lando et al. . |
| 3,485,285 | 12/1969 | Anderle . |
| 4,177,853 | 12/1979 | Anderson et al. . |
| 4,638,166 | 1/1987 | Baudro . |
| 4,647,488 | 3/1987 | Schnebly et al. . |
| 4,675,060 | 6/1987 | Schnebly et al. . |
| 4,799,524 | 1/1989 | Guermonprez . |
| 4,955,420 | 9/1990 | Marinescu et al. . |
| 5,285,838 | 2/1994 | Rapp et al. . |

FOREIGN PATENT DOCUMENTS

| | | |
|---|---|---|
| 1067458 | 12/1954 | France . |

*Primary Examiner*—Blair Johnson
*Attorney, Agent, or Firm*—Thomas J. Donovan, Esq.

[57] ABSTRACT

A window blind assembly having a bottom rail that defines a channel for receiving and storing unnecessary or unused slats of the blind assembly to enable the ready customization of the blind assembly to fit windows of different heights. End caps removably engageable with the ends of the storage rail may be provided for retaining the slats within the channel. Slots may be formed on each of the leading edges of the end caps, extending inwardly, for engaging a cover slat to enclose the storage rail and enhance the aesthetic appearance of the storage rail. Means are also provided for readily securing the storage rail to the cords of the blind assembly.

36 Claims, 3 Drawing Sheets

WINDOW BLIND WITH STORAGE RAIL

This application is a continuation-in-part of U.S. patent application Ser. No. 08/444,270, filed May 18, 1995.

FIELD OF THE INVENTION

The present invention relates to window blinds, and, more particularly, the customization of window blinds to fit windows of different heights.

BACKGROUND

Most commercially-available extensible window blind or window blind assemblies comprise a plurality of interconnected slats, a bottom rail or bar that usually is heavier than the individual slats to keep the blind relatively taut, and a head rail. A pair of vertical cords and a pair of ladder tapes interconnect the slats, the bottom rail and the head rail. The vertical cords are usually secured to the rail by plugs or caps that are received within apertures formed in the rail. A wand or tilt bar that is operably attached to the rungs of the ladder tapes is also included for tilting the slats. A pull cord is included for raising and lowering the blind.

Installation of most commercially-available window blinds within a window frame is tedious and time consuming and usually involves two stages. First, the installer secures the window blind to the window frame, which requires the use of tools, brackets and screws; and next, the installer shortens the window blind to fit it within the window frame and also to achieve equal spacing between the slats for aesthetic and functional reasons.

The second stage, which itself is tedious and time consuming, usually involves several steps. The installer first lowers the blind so that the bottom rail rests on the window sill. Next, the installer removes from underneath the bottom rail the plugs or caps that are secured within the apertures formed in the rail. The installer then unties the vertical cords extending underneath the rail, and separates the bottom rail from the blind by pulling it from the rungs of the ladder tapes. Next, the installer manually disconnects the desired number of slats from the vertical cords and pulls them from the rungs of the ladder tapes.

Thereafter, the installer re-connects the bottom rail to the blind by first re-inserting the bottom rail into the appropriate rungs of the ladder tapes. The cords are then inserted through the apertures of the rail and the lift cords are re-tied underneath the rail. The excess ladder tape rungs extending underneath the rail are then cut off with a scissors so that the rail rests on a bottom pair of rungs. A cover slat is then inserted on the top of the bottom rail, and the caps are replaced on the bottom rail.

Because of the difficulties and time spent in installing a window blind, individuals installing blinds for their own use tend to become frustrated and often will instead choose to hire professionals to install the blind. Further, companies and individuals that install blinds regularly in connection with their business, such as property managers and landlords, incur countless man hours and substantial expenses installing window blinds.

Moreover, the bottom rails of customized blinds have aesthetic drawbacks. For example, the blind installed in accordance with the above procedure includes a pair of ladder tapes and rungs that extend outside and around the bottom rail and a pair of plugs secured in the bottom rail. The ladder tapes and rungs and plugs detract from the appearance of the window blind because they are visible and because they prevent the bottom rail from resting snug on the window sill. The structure beneath the bottom rail also permits streaks of sunlight to pass beneath the blind.

Despite the foregoing, a window blind assembly which meets the above description has been widely accepted by the window blind industry. That window blind assembly, which is often referred to as the "mini-blind", has achieved popularity due in large part to the systematic manner in which the mini-blind can be customized, its aesthetically-acceptable appearance, and its ability to be mass manufactured at relatively low cost. Notwithstanding the commercial popularity of the mini-blind, however, for the reasons set forth above, its systematic manner of installation is tedious and time consuming and its bottom rail has aesthetic drawbacks due to the manner in which the mini-blind is installed.

Accordingly, it is an object of the present invention to provide a window blind or window blind assembly that can be customized to the desired length quickly and easily.

It is a further object of the present invention to provide such a window blind assembly having a bottom rail that provides aesthetic benefits.

It is a still further object of the present invention to provide a means for readily securing the rail to the window blind assembly.

SUMMARY

In accordance with these and other objects, a generally hollow and elongate bottom storage rail, bar or container for an extensible window blind or window blind assembly having a plurality of interconnected slats is provided for receiving and storing unnecessary or excess slats of the blind assembly. The storage rail enables the blind assembly to be customized or adjusted readily to be used with windows of different heights without having to remove or disconnect the unnecessary slats from the rest of the blind assembly.

In accordance with a preferred embodiment, the storage rail has a generally U-shaped cross-section substantially along its length to define an open channel for receiving and storing the unnecessary slats. The storage rail may include two open ends, and end caps may be provided that are removably engageable with the ends.

To customize or shorten to a desired length the window blind assembly in accordance with a preferred embodiment of the invention, after the blind assembly is secured to the window frame, the user manually gathers and inserts into the channel of the storage rail the unnecessary slats. Then, the user engages the removable end caps with the ends of the storage rail. Thereafter, the user may engage to the end caps a cover slat, which is the slat located next above the storage rail. The unnecessary slats thus may be retained within the storage rail by the end caps, the cover slat, the combination of the end caps and the cover slat, or by any suitable structure associated with the end caps or storage rail. The window blind assembly can then be raised or lowered in a conventional manner.

The invention may also include means for quickly and easily securing the storage rail to the vertical cords of the blind. In accordance with a preferred embodiment, the securing means comprises a slot formed on the bottom of the storage rail and connecting elements joined to the ends of the vertical cords that engage the storage rail within the slot and also can slide along the slot. Preferably, the connecting elements are in the form of twist-and-lock eyelets that engage the storage rail within the slot when the connecting elements are twisted. The connecting elements also can be readily disengaged from the storage rail by twisting them in an opposite direction.

The present invention provides a window blind assembly that can be customized to fit window frames of different heights quickly and easily without the use of any tools. The present invention enables individuals to install a blind assembly with minimal effort and without the need to consult professionals. Moreover, if the installer is an individual or company that is frequently installing window blind assemblies on a single property or multiple properties, such as a property manager or landlord, the present invention can save countless man hours and substantial expense. The present invention also may extend the useful life of the window blind assembly since it enables the window blind assembly to be quickly and easily lengthened or further shortened without the need to disconnect any of the interconnected slats of the blind assembly. Thus, the blind assembly is reusable with other windows and can be quickly and easily switched to a different size window, if desired. In addition, the holes that are drilled in the bottom rails of the prior art window blind assemblies to enable the blind assemblies to be shortened are eliminated in the present invention. By eliminating the holes, the present invention saves the time and expense of drilling holes in the bottom rail and also enhances the aesthetics of the rail.

Further, the present invention eliminates the bottom plugs and the bottom ladder tape that extends around and beneath the bottom rail. As a result, the storage rail in accordance with a preferred embodiment invention rests snugly on the window sill, and does not include unsightly ladder tapes or plugs. Because of its construction, the storage rail preferably also achieves substantially equal spacing between the individual slats that extend outside the storage rail when the blind assembly is in an extended position.

The storage rail also provides benefits in connection with the packaging of window blinds. For example, wands are usually packed loosely with the other components of the prior art window blind assemblies, and, as a result, the wands often bend or break during storage and transport of the packages containing the assemblies. With the present invention, however, the wand can be stored within the storage rail during packaging, which prevents the wand from bending or breaking. Storage of the wand within the storage rail also reduces the amount of material needed to package the window blind assembly, thereby reducing packaging and transportation costs.

Accordingly, the present invention provides a window blind assembly that can be customized quickly and easily, and that preferably is more aesthetically pleasing and less expensive to manufacture and package than the prior art window blind assemblies. As a result, the present invention is especially advantageous in connection with the popular mini-blind window blind assembly.

BRIEF DESCRIPTION OF THE DRAWINGS

The present invention and the advantages thereof will become more apparent upon consideration of the following detailed description when taken in conjunction with the accompanying drawings.

DESCRIPTION OF THE PREFERRED EMBODIMENTS

Figure 1:
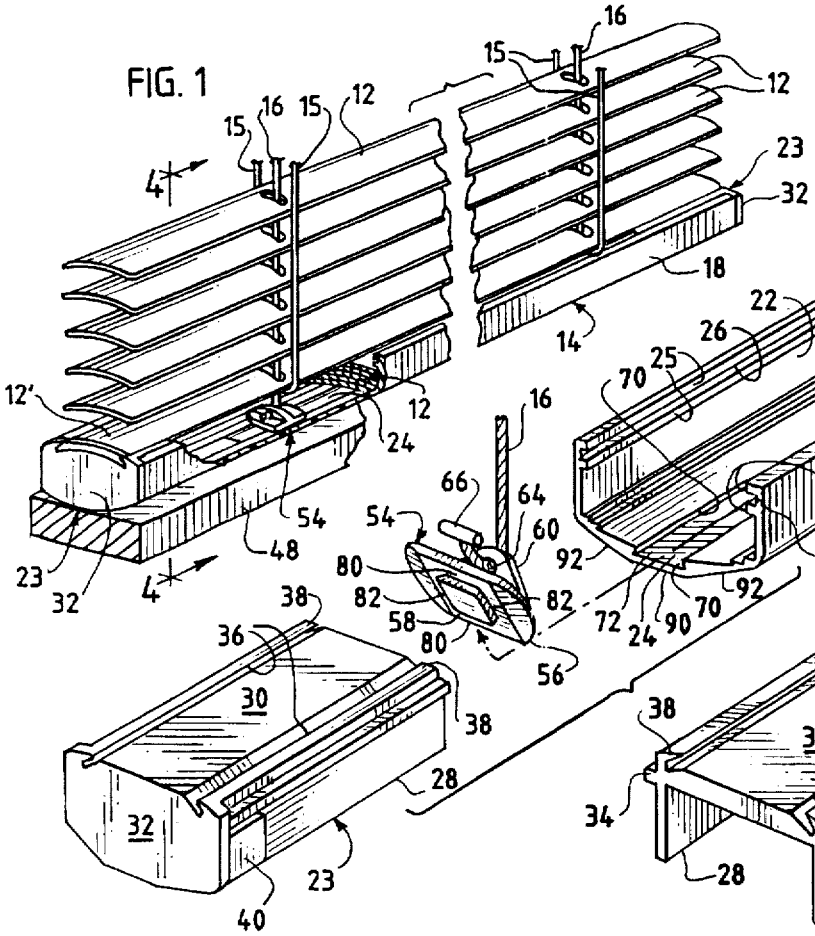
FIG. 1 is a partial perspective view of an extensible window blind that has a bottom storage rail in accordance with one embodiment of the present invention, illustrating in a partial cutaway view the storage rail and the slats retained within the storage rail.

FIG. 1 shows an extensible window blind or window blind assembly 10 comprising a plurality of interconnected slats 12 and a storage rail or bar 14 in accordance with one embodiment of the invention for receiving and storing unnecessary or unused interconnected slats 12 to adjust or shorten the length of the blind assembly. A pair of ladder tapes 15 and a pair of vertical cords 16 interconnect the slats 12, the storage rail 14, and, in accordance with convention, a head rail (not shown) of the blind assembly. The ladder tapes 15 define a plurality of rungs 17 that are disposed between the slats 12 for use in connection with tilting the slats.

In a preferred embodiment, the storage rail 14 is located at a bottom of the blind assembly 10 for storing the unnecessary slats 12 adjacent the bottom of the blind assembly to adjust the length of the assembly. The storage rail 14 comprises a pair of opposed walls 18 and a base 20 that define an open channel 22 for receiving the unnecessary slats 12. The cross-section of the storage rail 14 is generally U-shaped substantially along its length, with the open channel 22 facing upward. The ends of the storage rail 14 preferably are open. The bottom of the storage rail includes a flat bottom surface 90 that is disposed between a pair of inclined surfaces 92, which extend substantially along the length of the storage rail.

In the embodiment of FIGS. 1–6, a longitudinally-extending and generally U-shaped slot 24 is defined in the base 20 of the storage rail by a pair of slot walls 70 that extend upwardly and inwardly at a slight angle (preferably in the range of 5° to 15°) and a bottom 72. The slot 24 is defined directly above the flat bottom surface 90 and also extends along substantially the entire length of the storage rail 14. The slot 24 is adapted to receive a pair of connecting elements, as hereinafter described.

A pair of end caps 23 may be included that are removably engageable with the ends of the storage rail 14 to enclose the ends of the rail. Each end cap 23 comprises a pair of opposed side walls 28 and a projection which extends into the channel 22 and is adapted to retain the unnecessary slats 12 within the channel. In the embodiment of FIGS. 1–6, the projection is in the form of a tongue or ledge 30 that interconnects the opposed side walls 28. Each end cap 23 also includes an end wall 32 that preferably is of suitable shape to completely cover the open end of the storage rail 14. The tongue 30 extends substantially along the length of the opposed side walls 28 at or adjacent the tops of the side walls. Preferably, when the end caps 23 are engaged with the storage rail 14, the side walls are received substantially within the channel 22 of the storage rail, and the end walls 32 abut the ends of the storage rail (see, e.g. FIG. 1).

The end caps 23 may be engageable with storage rail 14 by a pair of lips 34 defined on the outside of the side walls 28 of the end caps 23 that are slidingly received within passages 26 defined by the storage rail. The lips 34 extend outwardly substantially along the length of each cap 23 and adjacent the tops of the side walls 28. The passages 26 are defined on each opposed wall 18 by a pair of parallel extensions 25 that extend inwardly from the opposed walls substantially along the length of the storage rail 14 adjacent the tops of the opposed walls.

Figure 2:
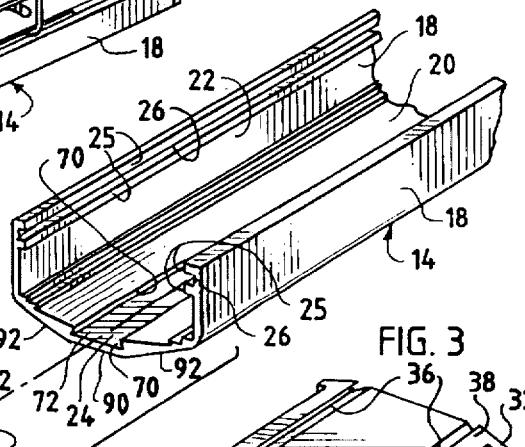
FIG. 2 is an exploded perspective view of the storage rail of FIG. 1 with the slats removed, illustrating a partial perspective view of the storage rail, and a perspective view of one of the end caps engageable with the storage rail and one of the twist-and-lock eyelets for securing the rail to the slats of the blind.
Figure 3:
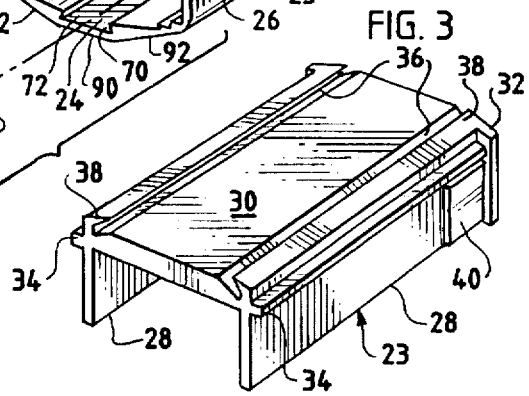
FIG. 3 is a perspective view of the other end cap of the storage rail of FIG. 2.
Figure 4:
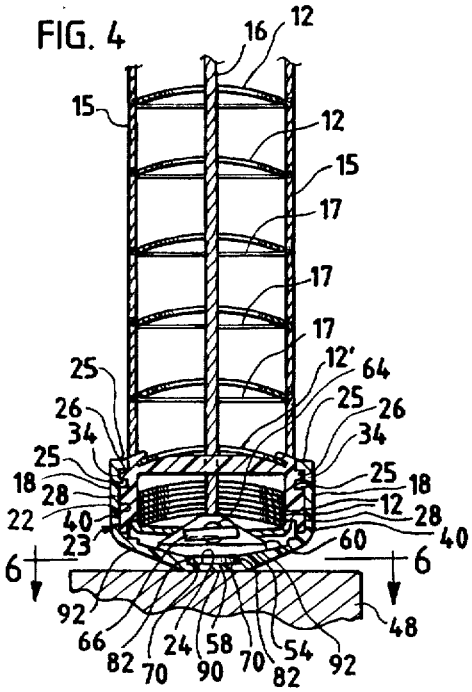
FIG. 4 is a cross section view taken along the plane 4—4 of FIG. 1.
Figure 5:
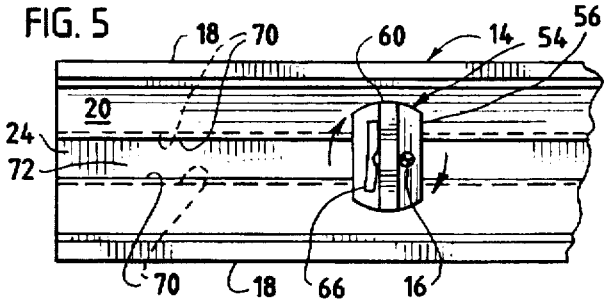
FIG. 5 is a partial plan view of the storage rail of FIG. 2 with one of the twist-and-lock eyelets shown received by the slot defined in the bottom of the storage rail, and illustrating with dashed lines the inclined walls that define the slot.

A pair of inwardly-facing slots 36 may be formed above the tongue 30 by a pair of cantilever members 38 that extend inwardly from the tops of the side walls 28. The slots 36 are adapted to receive the sides of a cover slat 12' to engage the cover slat with the end caps 23 and to substantially enclose the channel 22. The bottom of the cantilever member 38 and the sides of the tongue 30 immediately below the cantilever member 38 may be chamfered, as shown in FIGS. 2 and 3, to complement the slightly bowed configuration of a conventional slat. Alternatively, the extensions 25 of the storage rail 14 may instead (or additionally) be used to engage the cover slat 12' for enclosing the channel. The cover slat 12' enhances the aesthetics of the storage rail 14, facilitates tilting of the storage rail when the slats are tilted, and also may help retain the unnecessary slats 12 within the channel 22 of the storage rail 14.

If desired, additional structure may be included to enhance the engagement of the end cap 23 with the storage rail 14. For example, embossments 40 may be formed on the outside of the side walls 28 of the end cap 23 near the end walls 32 to increase the thickness of the side wall 28 and to provide a pressure fit engagement between the storage rail 14 and the end cap. In the embodiment of FIGS. 2 and 3, the embossments 40 are generally rectangular. If desired, the embossments 40 may be tapered. Alternatively, instead of the embossments 40, the outside of the side walls 28 may be tapered to enhance the engagement of the end cap 23 with the storage rail 14.

The width and length of the storage rail 14 preferably complement the width and length of the slats 12. For example, the distance between the opposed walls 18 preferably is in the range of ⅞" to 1⅛" for a slat that is 1" wide. The length of the storage rail 14 preferably is in the range of 23½" to 24" for a slat that is 23½" long. The height of the storage rail 14 depends upon the size of the blind assembly 10 and upon the desired aesthetics.

The height of the side walls 28 of the end caps 23 is substantially equal to or preferably less than the height of the opposed walls 18 of the storage rail 14. The tongue 30 and side walls 28 of the end cap 23 may have any suitable length, but preferably the two lengths are approximately the same so that the tongue and side walls 28 extend approximately the same distance within the channel 22.

The window blind assembly 10 in accordance with a preferred embodiment of the invention preferably is readily customized to achieve the desired height in the following manner. After the window blind assembly 10 is secured to a window frame in any suitable manner, the blind assembly is extended until the storage rail 14 rests on a window sill 48. Then, the unnecessary lower slats 12 are manually gathered and inserted into the storage rail 14. The end caps 23 are then engaged with the ends of the storage rail 14. Next, the cover slat 12' is engaged with the slots 36 formed in the end caps.

Thus, the unnecessary slats 12 are kept or retained within the channel 22 of the storage rail 14 by a retainer. The retainer may be in the form of one or both of the end caps 23, the cover slat 12', or the combination of the end caps and the cover slat. The retainer may instead (or additionally) be defined by any other suitable structure associated with the end caps 23 or the storage rail. For example, the retainer may be defined by one of the pairs of extensions 25 or may be defined by some other form of an extension or projection associated with one or both of the end caps 23 or the storage rail 14. If desired, the retainer could be defined by the end walls 32 of the end caps 23 or the opposed walls 18 of the storage rail which may be spaced apart a predetermined distance so that they are adapted to engage the unnecessary slats to retain them within the channel 22 of the storage rail. The retainer also may be defined by one or more clasps or clips engageable with the storage rail 14 or the end caps 23 that retain the unnecessary slats within the channel 22 of the storage rail 14, or could also be in the form of some type of an adhesive, fastening or magnetic means or structure capable of retaining the unnecessary slats within the channel.

The window blind assembly 10 is adjustable so that the length of the window blind assembly in a fully or otherwise extended position can be customized or adjusted to correspond to the size of the window. The customization of the blind assembly 10 in accordance with the present invention can be completed quickly and easily without the use of tools and without disconnecting any of the interconnected slats 12 from the blind assembly.

If it becomes necessary, thereafter, to secure the blind assembly 10 to another window frame or to lengthen (or shorten further) the blind assembly, the length of the blind assembly can be re-customized by disengaging the cover slat 12', removing the end caps 23 and removing one or more slats 12 from the storage rail 14 (or inserting additional unnecessary slats 12 into the storage rail). The end caps 23 are then replaced on the ends of the storage rail, and another cover slat 12' is secured to the end caps.

The storage rail 14 enhances the aesthetics of the blind assembly in several respects. For example, the ladder tapes 15 and rungs 17 associated with the unnecessary slats 12 extend within (and not around) the storage rail 14, leaving no ladder tapes or rungs to be seen outside or beneath the storage rail (see FIG. 4). The storage rail 14 also eliminates the need for drilling holes in the rail or for the plugs received within the holes. Further, the storage rail 14 preferably facilitates substantially equal spacing between the used slats of the blind assembly (i.e. the slats not stored within the storage rail 14) when the blind assembly is fully extended to enhance the aesthetics and operation of the blind assembly.

Additionally, because the cover slat 12' is engaged with the end caps, the storage rail tilts or pivots when the slats are tilted. The inclined surfaces 92 of the storage rail 14 also facilitate tilting or pivoting of the storage rail on the window sill 48 when the slats 12 are tilted. Thus, when the slats are tilted and the storage rail pivots onto one of the inclined surfaces, the view of the storage rail in one direction is shielded by the cover slat 12'. For example, when the slats 12 are tilted inwardly, the storage rail 14 is substantially hidden from view in the direction facing the inwardly-tilted slats.

The storage rail 14 may be constructed of any suitable material. If desired, the storage rail 14 may be lighter in weight than the prior art bottom rails and still function to keep the blind assembly taut since the slats stored in the storage rail 14 increase the weight of the storage rail. Thus, the storage rail 14 preferably is constructed of a material that is rigid and lightweight, such as, for example high impact polystyrene.

The storage rail 14 of the present invention may be secured at the bottom of the window blind assembly 10 in any suitable manner. In the preferred embodiment, however, the vertical cords 16 can be quickly and easily secured to the storage rail 14 by a pair of connecting elements joined to the ends of the cords 16. The connecting elements preferably are in the form of twist-and-lock eyelets 54 that are removably engageable with the base of the storage rail 14 within the slot 24.

In the embodiment of FIGS. 1–6, each twist-and-lock eyelet 54 comprises a member 56 having a boss 58 on one side and a bracket 60 on the other side. The bottom of the member 56 may be chamfered at its longitudinal ends to complement the slightly bowed configuration of the base 20 of the storage rail 14. The boss 58 and bracket 60 are preferably integral with the member 56, with the boss extending generally parallel to the member and the bracket extending generally perpendicular to the member.

Figure 6:
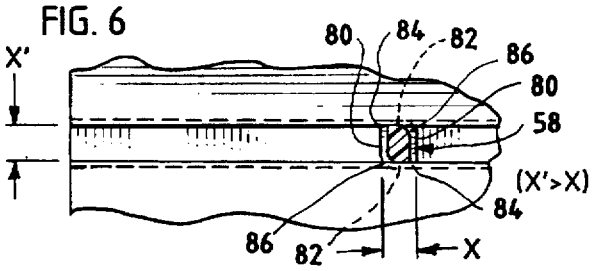
FIG. 6 is a cross section view taken along the lines 6—6 of FIG. 4, illustrating the boss of the twist-and-lock eyelet engaged with the storage rail within the slot and illustrating with dashed lines the inclined walls of the slot and the inclined walls of the boss engaged with the slot walls.

The boss 58 is generally rectangular and is defined by a pair of first walls 80, a pair of second walls 82, a pair of opposed square corners 84 and a pair of opposed rounded corners 86. Preferably, the length of the boss 58 is equal to or slightly less than the width of the slot 24, and the width of the boss 58 is equal to or slightly less than the length of the boss. As illustrated in FIG. 6, the first and second walls extend downwardly from member 56 and outwardly at a slight angle (preferably in the range of 5° to 15°) to complement the slight incline of slot walls 70 of the storage rail 14. Each bracket 60 of eyelet 54 includes an aperture 64 for receiving one of the vertical cords 16, and a bead or tab 66 may be secured to the end of the cord to keep the cord secured to the bracket 60.

To readily secure the cords 16 to the storage rail 14, each twist-and-lock eyelet 54 is inserted into the slot 24 with first walls 80 extending in the direction of the longitudinal axis of the storage rail. The eyelet is twisted approximately 90 degrees relative to the rail 14 to cause the boss 58 to engage slot walls 70. The twisting engagement of the boss with the slot walls is facilitated by the rounded corners 86 which provide a camming effect, and by the inclined slot walls 70 of the storage rail 14 and the inclined first and second walls 80, 82 of the boss 58.

Once the twist-and-lock eyelet 54 and the storage rail 14 are engaged, the eyelets 54 can be moved to a different position along the slot 24 with manual pressure so that the cords can be secured to the storage rail 14 at the desired location. The twist-and-lock eyelets 54 can be disengaged from the rail 14 by twisting the eyelets in the reverse direction.

FIGS. 7–15 illustrate alternative embodiments of the storage rail 114, the pair of end caps 123 and the pair of twist-and-lock eyelets 154. The storage rail 114 illustrated in FIGS. 7 and 8 includes a pair of L-shaped extensions 125 for engaging the pair of end caps 123. Each L-shaped extension projects from one of the opposed walls 118, facing the base 120 of the storage rail 114. If desired, the L-shaped extensions 125 may alternatively (or additionally) engage the cover slat to retain the unnecessary slats 12 within the channel 122 of the storage rail 114 or the L-shaped extensions may themselves retain the unnecessary slats within the channel of the storage. In this regard, due to their configuration, the L-shaped extensions 125 generally may be more effective in engaging and locking the end caps 123 to the storage rail 114, especially when there is a large supply of unnecessary slats.

Figure 9:
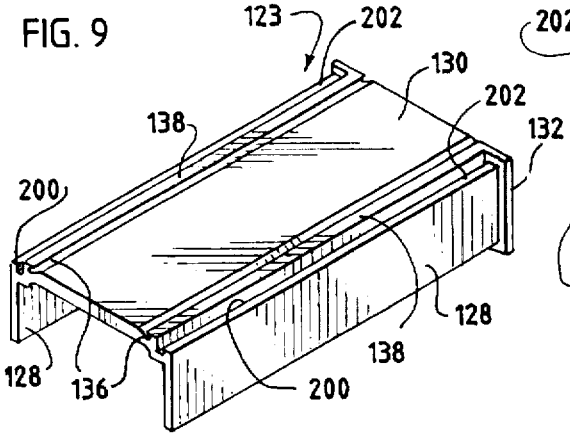
FIG. 9 is a perspective view of one of the end caps engageable with the storage rail of FIGS. 7 and 8.
Figure 10:
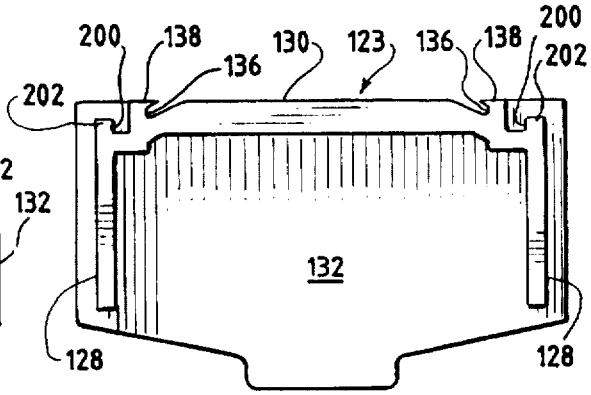
FIG. 10 is an end view of the end cap of FIG. 9.

As illustrated in FIGS. 9 and 10, each end cap 123 includes a pair of opposed side walls 128 joined together by the projection or tongue 130 that preferably is configured to retain the unnecessary slats 12 within the channel 122, and the end wall 132 that is configured to cover the end of the storage rail. A pair of passages 200 is defined on the top of the opposed sides of the tongue 130 for slidingly receiving the L-shaped extensions 125 of the storage rail 114 to engage the end caps with the storage rail. The passages 200 are defined by the tops of the opposed walls 118 of the storage rail and by a pair of walls 202 extending from the top of the tongue. The inwardly-facing slots 136 may be defined by the cantilever members 138, which extend from the walls 202. The cantilever members 138 and a portion of the tongue 130 adjacent the cantilever members may be chamfered to complement the slightly bowed configuration of the conventional slat.

Figure 7:
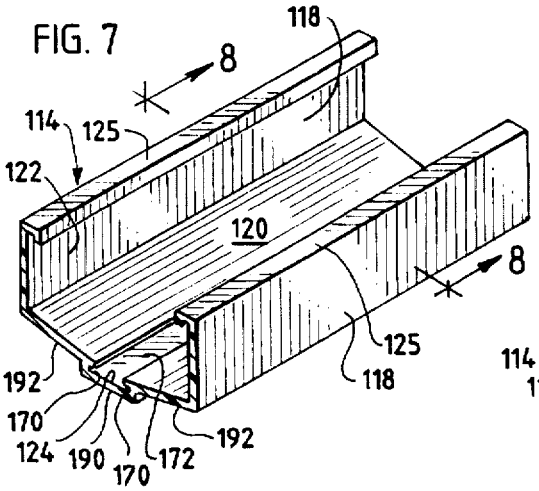
FIG. 7 is a partial perspective view of a bottom storage rail in accordance with another embodiment of the invention.
Figure 8:
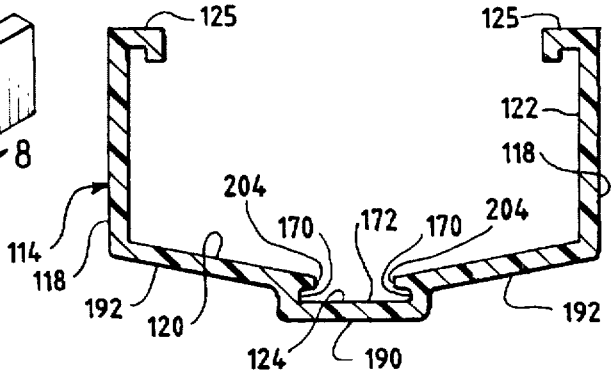
FIG. 8 is a cross section taken along the lines 8—8 of FIG. 7.
Figure 11:
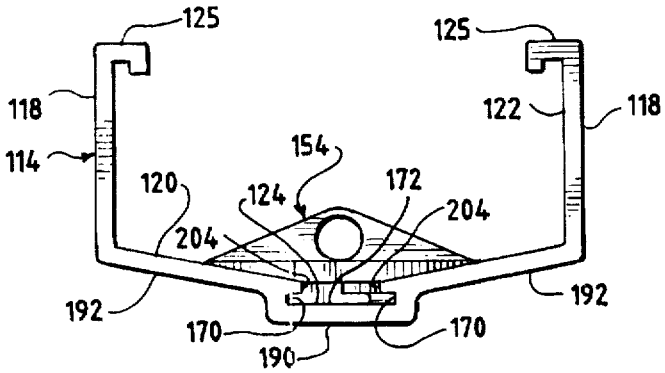
FIG. 11 is an end view of the storage rail of FIGS. 7 and 8 illustrating a twist-and-lock eyelet in accordance with an alternative embodiment for securing the rail to the slats of the blind.
Figure 12:
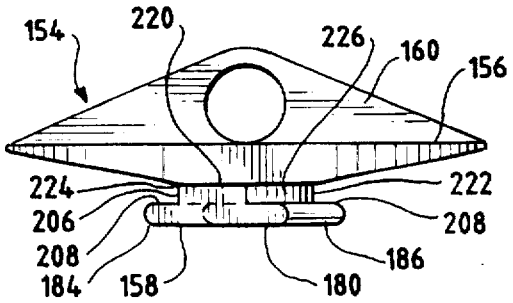
FIG. 12 is an enlarged view of the twist-and-lock eyelet of FIG. 11.
Figure 15:
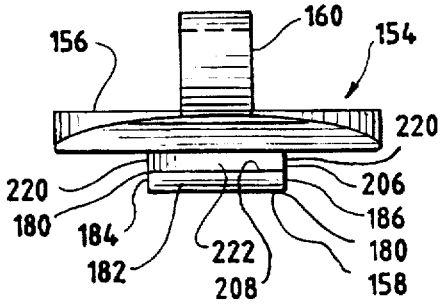
FIG. 15 is an end view of the twist-and-lock eyelet of FIGS. 11–14.
Figure 13:
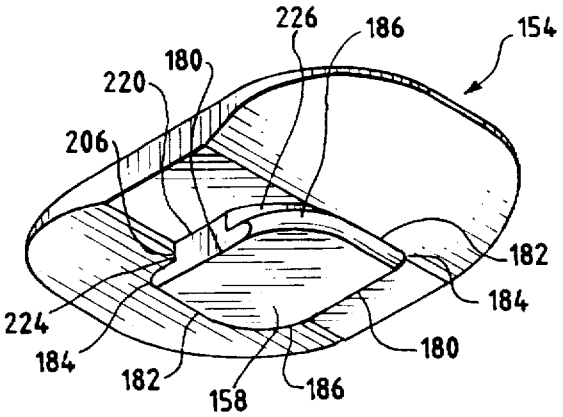
FIG. 13 is a perspective view of the bottom of the twist-and-lock eyelet of FIGS. 11–12.
Figure 14:
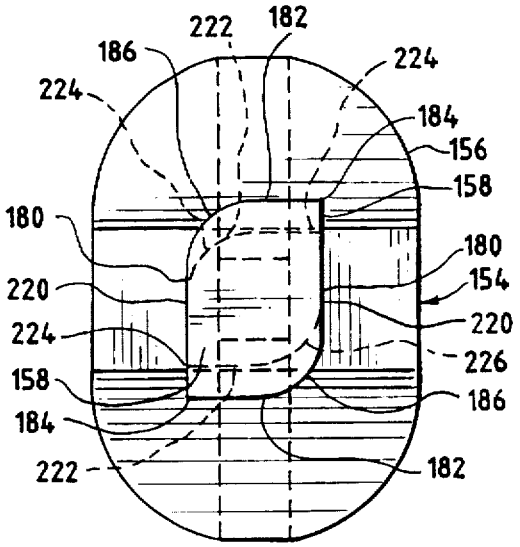
FIG. 14 is a bottom view of the twist-and-lock eyelet of FIGS. 11–13.

The slot 124 of the storage rail 114 is adapted to engage the twist-and-lock eyelet 154 of FIGS. 11–15. As illustrated in FIGS. 7, 8 and 11, the slot 124 is defined by the pair of slot walls 170, the bottom 172, and a pair of opposed shoulders 204 that extend substantially along the length of the rail 14.

Each twist-and-lock eyelet 154 includes the member 156, the boss 158, the bracket 160, and a neck 206 joining the member and the boss. The boss 158 and the neck 206 define a pair of channels 208 adapted to receive the shoulders 204 of the storage rail 114 when the eyelet 154 is engaged within the slot 124.

The boss 158 of each twist-and-lock eyelet 154 is generally rectangular and is defined by a pair of generally parallel first walls 180, a pair of generally parallel second walls 182, a pair of opposed square corners 184, and a pair of opposed rounded corners 186. Preferably, the length of boss 158 is equal to or slightly less than the width of the slot 124, and the width of the second walls 182 is equal to or slightly less than the length of the boss. The opposed rounded corners 186 facilitate a camming effect when the twist-and-lock eyelets 154 are twisted and engaged within the slots 124. In the embodiment illustrated in FIGS. 11–16, the first and second walls 180 and 182 are not inclined.

Preferably, the neck 206 has a similar construction to the boss 158 except that it is shorter in length than the boss. The neck 206 may be generally rectangular or square and is defined by a pair of generally parallel first walls 220, a pair of generally parallel second walls 222, a pair of opposed square corners 224 and a pair of opposed rounded corners 226. Preferably, the length of neck 206 is equal to or slightly less than the distance between the opposed shoulders 204 of the storage rail, and the width of the neck 206 is the same as the width of the boss 158. The opposed rounded corners 226 facilitate a camming effect with the shoulders 204 when the twist-and-lock eyelets 154 are twisted and engaged within the slots 124.

In accordance with further embodiments, the invention can be employed in other window treatments, such as, for example, pleated or honeycomb window shades. The window treatments in accordance with these further embodiments of the invention include the storage rail and the retainer for retaining a lower, unnecessary portion of the shade within the channel of the storage rail to adjust the length of the window treatment. The retainer includes structure capable of retaining the lower, unnecessary portion of the shade within the channel of the storage rail.

The foregoing description is for purposes of illustration only and is not intended to limit the scope of protection accorded this invention. The scope of protection is to be measured by the following claims, which should be interpreted as broadly as the inventive contribution permits.

What is claimed is:

1. A blind assembly comprising:

(a) a plurality of substantially horizontal slats interconnected by at least one cord;

(b) a storage rail connected to the plurality of slats and defining a channel for receiving some of the interconnected slats to adjust the length of the blind assembly; and (c) a retainer for retaining said some of the interconnected slats within the channel.

2. The blind assembly of claim 1 wherein the storage rail includes two ends and the retainer comprises at least one end cap engageable with one of the ends of the storage rail.

3. The blind assembly of claim 2 wherein the retainer comprises two end caps, each end cap engageable with a respective end of the storage rail.

4. The blind assembly of claim 2 wherein one of the other interconnected slats is engageable with the end cap to substantially enclose the channel.

5. The blind assembly of claim 2 wherein the end cap includes a projection extending into the channel when the end cap is engaged with the one end of the storage rail to retain said some of the interconnected slats within the channel.

6. The blind assembly of claim 5 wherein the projection is a tongue.

7. The blind assembly of claim 6 wherein the end cap includes a pair of opposed side walls interconnected by the tongue and the storage rail comprises a pair of extensions engageable with the opposed side walls.

8. A blind assembly comprising:

(a) a plurality of interconnected slats;

(b) a storage rail defining a channel for receiving a predetermined number of the interconnected slats to adjust the length of the blind assembly; and (c) a retainer for retaining the predetermined number of the interconnected slats within the channel wherein the retainer comprises one of the other interconnected slats, said one of the other interconnected slats being engageable with the storage rail.

9. The blind assembly of claim 1 further comprising a pair of end caps and wherein the storage rail includes two ends engageable with the end caps.

10. A blind assembly comprising:

(a) a plurality of interconnected slats;

(b) a storage rail defining a channel for receiving a predetermined number of the interconnected slats to adjust the length of the blind assembly;

(c) a retainer for retaining the predetermined number of the interconnected slats within the channel; and (d) a pair of end caps;

wherein the storage rail includes two ends engageable with the end caps and wherein the retainer comprises one of the other interconnected slats, said one of the other interconnected slats being engageable with the end caps.

11. The blind assembly of claim 9 wherein the storage rail is elongated and includes a pair of opposed walls extending substantially along the length of the storage rail, each opposed wall including an extension engageable with at least one end cap.

12. The blind assembly of claim 1 wherein the storage rail is elongated and further comprises a pair of opposed walls extending substantially along the length of the storage rail and the retainer comprises a pair of extensions extending from the opposed walls.

13. The blind assembly of claim 1 wherein the storage rail is elongated and further comprises a pair of opposed walls extending substantially along the length of the storage rail and a base interconnecting the opposed walls to define the channel, the cross-section of the storage rail being generally U-shaped substantially along the length of the storage rail.

14. The blind assembly of claim 1 wherein the storage rail has a bottom having at least one inclined surface to facilitate pivoting of the storage rail when the storage rail is positioned on a window sill and when the interconnected slats are tilted.

15. The blind assembly of claim 1 further including a top and a bottom and wherein the storage rail is secured at the bottom of the blind assembly.

16. The blind assembly of claim 1 wherein the storage rail defines a slot, the blind assembly further comprising:

at least one cord interconnecting the plurality of interconnected slats; and at least one connecting element secured to the cord for releasably connecting the cord to the storage rail.

17. The blind assembly of claim 16 wherein there are two cords and two connecting elements, each connecting element secured to a respective cord.

18. The blind assembly of claim 16 wherein the connecting element comprises a boss engageable with the storage rail when the boss is received within the slot and when the connecting element is twisted from a first position to a second position.

19. The blind assembly of claim 18 wherein the boss includes at least one rounded corner to facilitate twisting engagement of the boss and the storage rail.

20. The blind assembly of claim 19 wherein the storage rail includes a base and a pair of opposed walls that define the channel, the slot being defined in the base and extending along a longitudinal axis of the storage rail, the boss having a length that extends along the longitudinal axis of the storage rail when the connecting element is in the first position and a width that extends along the longitudinal axis of the storage rail when the connecting element is in the second position.

21. The blind assembly of claim 19 wherein the slot is defined by a pair of opposed slot walls and a pair of opposed inwardly-facing shoulders, each shoulder extending from a respective slot wall, and wherein the connecting element defines a pair of connecting element channels adapted to receive the shoulders when the connecting element is in the second position.

22. The blind assembly of claim 21 wherein the pair of connecting element channels are defined by a neck joined to the boss, the neck including at least one rounded corner to facilitate twisting engagement of the connecting element and the storage rail.

23. The blind assembly of claim 18 wherein the slot is defined by a pair of opposed and inclined slot walls and the boss includes a pair of tapered walls that complement the inclined slot walls.

24. The blind assembly of claim 1 wherein the storage rail is connected to the plurality of slats by said at least one cord.

25. A blind assembly comprising:

a plurality of interconnected slats;

at least one cord interconnecting the interconnected slats;

a bottom rail having opposed side walls and a bottom surface defining a channel and further defining a slot in said bottom surface; and at least one connecting element secured to the cord for releasably connecting the cord to the rail, the connecting element comprising a boss engageable with the rail when the connecting element is twisted from a first position to a second position;

wherein the slot is defined by a pair of opposed longitudinally extending slot walls and a pair of opposed longitudinally extending inwardly-facing shoulders, each shoulder extending from a respective slot wall, and wherein the connecting element defines a pair of connecting element channels adapted to receive the shoulders when the connecting element is in the second position.

26. The blind assembly of claim 25 wherein there are two cords and two connecting elements, each connecting element secured to a respective cord.

27. The blind assembly of claim 25 wherein the connecting element comprises a boss engageable with the rail when the boss is received within the slot and when the connecting element is twisted from a first position to a second position.

28. The blind assembly of claim 27 wherein the boss includes at least one rounded corner to facilitate twisting engagement of the boss and the rail.

29. The blind assembly of claim 28 wherein the boss having a length that extends along the longitudinal axis of the rail when the connecting element is in the first position and a width that extends along the longitudinal axis of the rail when the connecting element is in the second position.

30. The blind assembly of claim 25 wherein the pair of connecting element channels are defined by a neck joined to the boss, the neck including at least one rounded corner to facilitate twisting engagement of the connecting element and the rail.

31. The blind assembly of claim 27 wherein the slot is defined by a pair of opposed and inclined slot walls and the boss includes a pair of tapered walls that complement the inclined slot walls.

32. A method of adjusting an extensible window blind assembly to have a predetermined length, the window blind assembly including a plurality of slats interconnected by at least one cord and a generally hollow storage rail comprising a pair of ends and defining a channel, the method comprising the steps of inserting some of the interconnected slats into the channel to achieve the predetermined length and of engaging the end caps with the ends of the storage rail to retain said some of interconnected slats within the channel.

33. A method of adjusting an extensible window blind assembly to have a predetermined length, the window blind assembly including a plurality of interconnected slats and a generally hollow storage rail comprising a pair of ends and defining a channel, the method comprising the steps of inserting a predetermined number of the interconnected slats into the channel to achieve the predetermined length of engaging the end caps with the ends of the storage rail to retain the predetermined number of interconnected slats within the channel, and of engaging one of the other interconnected slats with the end caps to substantially enclose the channel.

34. A method of adjusting an extensible window blind assembly to have a predetermined length, the window blind assembly including a plurality of slats interconnected by at least one cord and a generally hollow storage rail comprising a pair of ends and defining a channel, the method comprising the steps of inserting some of the interconnected slats into the channel to achieve the predetermined length and of engaging one of the other interconnected slats to the storage rail to retain said some of the interconnected slats within the channel.

35. A method of adjusting an extensible window blind assembly to have a predetermined length, the window blind assembly including a plurality of slats interconnected by at least one cord and a generally hollow storage rail comprising a pair of ends and defining a channel, the method comprising the steps of inserting some of the interconnected slats into the channel to achieve the predetermined length and of engaging an end cap with one of the ends of the storage rail to retain said some of the interconnected slats within the channel.

36. The method of claim 35 wherein the engaging step also includes engaging an other end cap with the other end of the storage rail.

* * * * *